US011328848B2

(12) United States Patent
Utsuno et al.

(10) Patent No.: US 11,328,848 B2
(45) Date of Patent: May 10, 2022

(54) DUST CORE, POWDER FOR MAGNETIC CORES, AND METHODS OF MANUFACTURING THEM

(71) Applicant: DENSO CORPORATION, Kariya (JP)

(72) Inventors: Seishi Utsuno, Nagakute (JP); Jung hwan Hwang, Nagakute (JP); Ken Matsubara, Kariya (JP)

(73) Assignee: DENSO CORPORATION, Kariya (JP)

( * ) Notice: Subject to any disclaimer, the term of this patent is extended or adjusted under 35 U.S.C. 154(b) by 269 days.

(21) Appl. No.: 16/497,238

(22) PCT Filed: Jan. 29, 2018

(86) PCT No.: PCT/JP2018/002663
§ 371 (c)(1),
(2) Date: Sep. 24, 2019

(87) PCT Pub. No.: WO2018/186006
PCT Pub. Date: Oct. 11, 2018

(65) Prior Publication Data

US 2020/0381152 A1 Dec. 3, 2020

(30) Foreign Application Priority Data

Apr. 3, 2017 (JP) ..... JP2017-073957

(51) Int. Cl.
*H01F 1/34* (2006.01)
*B22F 1/02* (2006.01)
(Continued)

(52) U.S. Cl.
CPC ..... *H01F 1/344* (2013.01); *B22F 1/142* (2022.01); *B22F 1/16* (2022.01); *B22F 9/082* (2013.01);
(Continued)

(58) Field of Classification Search
None
See application file for complete search history.

(56) References Cited

U.S. PATENT DOCUMENTS 7,083,760 B2 8/2006 Kondo et al.
2002/0034453 A1 3/2002 Kondo et al.
2004/0238796 A1 12/2004 Abe

FOREIGN PATENT DOCUMENTS

JP 3309970 B2 7/2002
JP 2003151813 A 5/2003
(Continued)

OTHER PUBLICATIONS

Machine translation of JP 2005-068526A. (Year: 2005).*
(Continued)

*Primary Examiner* — Xiaowei Su
(74) *Attorney, Agent, or Firm* — Harness, Dickey & Pierce, P.L.C.

(57) ABSTRACT

A dust core including soft magnetic particles having pure iron or an iron alloy and a grain boundary layer present between adjacent soft magnetic particles. The grain boundary layer has a main phase and a barrier phase. The main phase having a spinel-type ferrite of a metal element. The metal element serves as a divalent cation. The barrier phase having one or more of Cu, Sn, or Co. The dust core can be obtained by using a powder for magnetic cores including soft magnetic particles coated with a film in which a first ferrite and a second ferrite coexist. The barrier phase blocks the Fe diffusion from the soft magnetic particles and suppresses the deterioration of the main phase having the second ferrite responsible for the insulating property.

5 Claims, 4 Drawing Sheets

$$M1\ Fe_2O_4 + Fe \rightarrow M1 + Fe_3O_4\ (\text{or } FeO)$$

(51) Int. Cl.

| | |
|---|---|
| ***B22F 9/08*** | (2006.01) |
| ***C22C 33/02*** | (2006.01) |
| ***H01F 3/08*** | (2006.01) |
| ***B22F 1/16*** | (2022.01) |
| ***B22F 1/142*** | (2022.01) |
| *H01F 41/02* | (2006.01) |

(52) U.S. Cl.
CPC ..... *C22C 33/02* (2013.01); *H01F 3/08* (2013.01); *B22F 2009/0824* (2013.01); *C22C 2202/02* (2013.01); *H01F 41/0246* (2013.01)

(56) References Cited

FOREIGN PATENT DOCUMENTS

| | | | | |
|---|---|---|---|---|
| JP | 2005068526 | A | * | 3/2005 |
| JP | 2005085967 | A | | 3/2005 |
| JP | 2005142241 | A | | 6/2005 |
| JP | 2005142514 | A | | 6/2005 |
| JP | 2005340368 | A | | 12/2005 |
| JP | 200697097 | A | | 4/2006 |
| JP | 4024705 | B2 | | 12/2007 |
| JP | 2013191839 | A | | 9/2013 |
| JP | 2014183199 | A | | 9/2014 |
| JP | 201686124 | A | | 5/2016 |
| JP | 2016127042 | A | | 7/2016 |
| JP | 201754910 | A | | 3/2017 |
| WO | WO-03015109 | A1 | | 2/2003 |

OTHER PUBLICATIONS

Japanese Office Action for Japanese Patent Applicaiton No. 2017-073957, dated May 21, 2019 (with English Translation).
International Search Report (English and Japanese) issued in PCT/JP2018/002663, dated Apr. 17, 2018.

* cited by examiner

DUST CORE, POWDER FOR MAGNETIC CORES, AND METHODS OF MANUFACTURING THEM

CROSS REFERENCE TO RELATED APPLICATIONS

This application is a U.S. National Phase Application under 35 U.S.C. 371 of International Application No. PCT/JP2018/002663 filed on Jan. 29, 2018, which claims the benefit of priority from Japanese Patent Application No. 2017-073957 filed on Apr. 3, 2017. The entire disclosures of all of the above applications are incorporated herein by reference.

FIELD

The present invention relates to a dust core comprising soft magnetic particles insulated by a spinel-type ferrite and relates also to relevant techniques.

BACKGROUND

There are a considerable number of products utilizing electromagnetism, such as transformers, motors, generators, speakers, inductive heaters, and various actuators. Many of them utilize an alternating magnetic field and are usually provided with a magnetic core (soft magnet) in the alternating magnetic field in order to obtain a large alternating magnetic field locally and efficiently.

Magnetic cores are required not only to have high magnetic properties in an alternating magnetic field but also to have a less high-frequency loss (referred to as an "iron loss," hereinafter, regardless of the material of magnetic core) when used in an alternating magnetic field. Examples of the iron loss include an eddy-current loss, a hysteresis loss, and a residual loss, among which the eddy-current loss is important and should be reduced because it increases with the square of the frequency of an alternating magnetic field.

Such magnetic cores in practical use may be compressed powder magnetic cores (referred herein to as "dust cores") comprising soft magnetic particles (particles of powder for magnetic cores) with insulating coating. The dust cores are used in various electromagnetic devices because of a low eddy-current loss and a high degree of freedom in the shape. However, when the insulating layer present between adjacent soft magnetic particles (at the grain boundary) comprises nonmagnetic silicon particles, resin, compound, or the like, the magnetic properties (such as saturation magnetic flux density and permeability) may deteriorate depending on the nonmagnetic insulating layer. In this context, there are proposed dust cores with insulating layers of a spinel-type ferrite (also simply referred to as "ferrite") that is a magnetic material, and relevant descriptions are found in the following patent documents.

PATENT DOCUMENTS

Patent Document 1 JP2003-151813A
Patent Document 2 JP2005-340368A
Patent Document 3 JP2005-142241A
Patent Document 4 JP2006-97097A
Patent Document 5 JP2016-127042A
Patent Document 6 JP2016-86124A

SUMMARY

Ferrites proposed in Patent Documents 1 to 5 all comprise a metal element (M) such as Mn or Zn, Fe, and O. The insulating layer proposed in Patent Document 6 comprises a mixture layer of silicon particles and specific ferrite particles comprising Ni—Zn—Cu that is free from Fe.

The present invention has been made in view of such circumstances and an object of the present invention is to provide a dust core in which the grain boundary of soft magnetic particles is provided with a novel insulating layer different from conventional ones. Another object of the present invention is to provide relevant techniques thereto.

Solution to the Problem

As a result of intensive studies to achieve the above objects, the present inventors have successfully obtained a dust core that develops a high volume specific resistance (simply referred to as a "specific resistance") even after heat treatment (annealing), by precipitating Cu and the like in an insulating layer comprising a ferrite. Developing this achievement, the present inventors have accomplished the present invention as will be described hereinafter.

Dust Core (1) An aspect of the present invention provides a dust core comprising: soft magnetic particles comprising pure iron or an iron alloy; and a grain boundary layer present between adjacent the soft magnetic particles. The grain boundary layer has a main phase and a barrier phase. The main phase comprises a spinel-type ferrite ($M_xFe_{3-x}O_4$, $0<x\leq1$) of a metal element (M), Fe, and O. The metal element (M) serves as a divalent cation. The barrier phase comprises one or more of Cu, Sn, or Co.

(2) The dust core of the present invention can stably exhibit a high specific resistance even when exposed to a high-temperature environment and/or used for a long period of time. For example, even when heat treatment (annealing) is performed for the purpose of removing the strain introduced into the soft magnetic particles during compression molding, the grain boundary layer according to the present invention is less likely to deteriorate in the insulating property, and the dust core of the present invention can stably maintain the high specific resistance. As a result, the dust core of the present invention can have both the reduced eddy-current loss due to the high insulating property of the grain boundary layer and the reduced hysteresis loss due to the lowered coercivity of the soft magnetic particles at high levels.

The reason that the dust core of the present invention can stably maintain the high specific resistance is considered under the present circumstances as follows. Unlike the conventional insulating layers, the grain boundary layer according to the present invention has the barrier phase, which comprises one or more of Cu, Sn, or Co (also simply referred to as a "first metal element" or "M1), in addition to the main phase comprising a ferrite that is a magnetic material having a high insulating property. Cu or the like that constitutes the barrier phase has a small solid solubility limit to Fe (i.e., the solid-solution range is narrow) and can block the Fe diffusion from the soft magnetic particles to the ferrite. This consequently suppresses the phenomenon that Fe diffusing from the soft magnetic particles reduces Fe in the main phase ($Fe^{3+}+e^{-}\rightarrow Fe^{2+}$) so that the ferrite having a high insulating property changes to FeO or the like having a low insulating property.

The dust core of the present invention has the grain boundary layer in which the main phase and the barrier phase coexist, and it is thus supposed that the main phase responsible for the insulating property is protected by the barrier phase and the high specific resistance is stably maintained.

Powder for Magnetic Cores (1) The present invention can be perceived not only as the dust core but also as a powder for magnetic cores that is a raw material of the dust core. That is, the present invention may also be a powder for magnetic cores that comprises particles for magnetic cores. The particles have: soft magnetic particles comprising pure iron or an iron alloy; and a film that coats the soft magnetic particles. The film has a main phase and a barrier phase. The main phase comprises a spinel-type ferrite ($M_xFe_{3-x}O_4$, $0<x\leq1$) comprising a metal element (M), Fe, and O. The metal element (M) serves as a divalent cation. The barrier phase comprises one or more of Cu, Sn, or Co.

In the powder for magnetic cores of the present invention, the above-described barrier phase is preliminarily formed in the film for the soft magnetic particles. The above-described dust core can be obtained by using the powder for magnetic cores.

(2) The present invention can also be perceived as a powder for magnetic cores that comprises particles for magnetic cores. The particles have: soft magnetic particles comprising pure iron or an iron alloy; and a film that coats the soft magnetic particles. The film has: a first spinel-type ferrite ($M1_yFe_{3-y}O_4$, $0<y\leq1$) comprising a first metal element (M1), Fe, and O, the first metal element (M1) comprising one or more of Cu, Sn, or Co; and a second spinel-type ferrite ($M2_zFe_{3-z}O_4$, $0<z\leq1$) comprising one or more second metal elements (M2), Fe, and O, the one or more second metal elements (M2) being different from the first metal element (M1) and serving as divalent cations.

In the powder for magnetic cores of the present invention or the dust core obtained using the powder, the first metal element (such as Cu) in the first spinel-type ferrite (simply referred to as a "first ferrite") is preferentially reduced to precipitate ($Cu^{2+}+2e^{-}\rightarrow Cu$) by Fe diffusing from the underlying soft magnetic particles, and the above-described barrier phase is generated. Thus, also when the powder for magnetic cores of the present invention is used, the above-described dust core can be obtained.

Method of Manufacturing Powder for Magnetic Cores

The above-described powder for magnetic cores can be obtained, for example, by the production method of the present invention as below. That is, there is provided a method of manufacturing a powder for magnetic cores. The method comprises a ferrite generation step of generating a spinel-type ferrite on surfaces of soft magnetic particles comprising pure iron or an iron alloy. The ferrite generation step comprises: a first generation step of generating, on the surfaces of the soft magnetic particles, a first spinel-type ferrite ($M1_yFe_{3-y}O_4$, $0<y\leq1$) comprising a first metal element (M1), Fe, and O, the first metal element (M1) comprising one or more of Cu, Sn, or Co; and a second generation step of generating a second spinel-type ferrite ($M2_zFe_{3-z}O_4$, $0<z\leq1$) comprising one or more second metal elements (M2), Fe, and O, the one or more second metal elements (M2) being different from the first metal element (M1) and serving as divalent cations.

The powder after the ferrite generation step may be preliminarily heat-treated before being formed or molded into a dust core (powder heating step). This can promote the densification of the film coating the soft magnetic particles and the generation of the above-described barrier phase (e.g. M1 precipitation).

The densification of the film and the generation of the barrier phase may be separately performed or may also be performed in parallel. For example, the heating temperature may be set within a low-temperature region (e.g. 480° C. or lower in an embodiment and 430° C. or lower in another embodiment) thereby to allow the film to be densified without generation of the barrier phase (M1 precipitation). In this case, the barrier phase may be generated, for example, during the heat treatment for the dust core (annealing).

In contrast, the heating temperature may be set within a high-temperature region (e.g. 520° C. or higher in an embodiment and 570° C. or higher in another embodiment) thereby to allow both the densification of the film and the generation of the barrier phase to occur in parallel.

The densified film is thought to be less likely to cause deformation, cracks, etc. during compression molding of the powder for magnetic cores and is also thought to prevent direct contact between the soft magnetic particles and contribute to a high specific resistance of the dust core. In addition or alternatively, the densification of the film may be applied to a film that already has the barrier phase.

Method of Manufacturing Dust Core

The above-described dust core can be obtained, for example, by a method of manufacturing a dust core. This method comprises a molding step of compression-molding any of the above-described powders for magnetic cores.

Others (1) In the present description, not only when one type of a metal element is used but also when plural types of metal elements are used, they are abbreviated as "M," "M1," or "M2" for descriptive purposes. When plural types of metal elements are used, "x," "y," or "z" representing the composition ratio (atomic ratio) indicates the total of respective metal elements. For example, when M comprises Mn and Zn, "Mx" means $Mn_{x1}Zn_{x2}$, where $x=x1+x2$ and $0<x1\cdot x2$.

(2) Unless otherwise stated, a numerical range "x to y" as referred to in the present description includes the lower limit x and the upper limit y. Any numerical value included in various numerical values or numerical ranges described in the present description may be selected or extracted as a new lower or upper limit, and any numerical range such as "a to b" can thereby be newly provided using such a new lower or upper limit.

DETAILED DESCRIPTION

Figure 1:
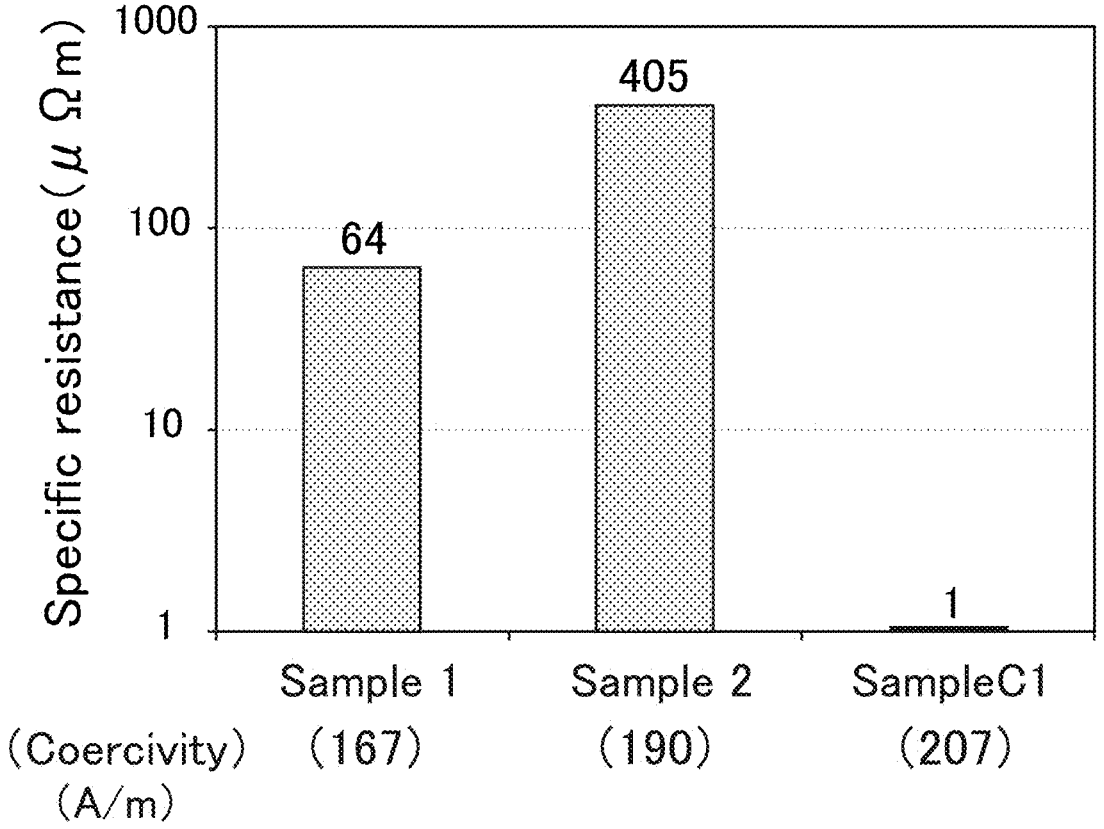
FIG. 1 is a bar graph illustrating the specific resistance of dust cores according to the samples.

One or more features freely selected from the present description can be added to the above-described features of the present invention. The contents described in the present description can be applied not only to the dust core and powder for magnetic cores of the present invention but also to methods of manufacturing them. Contents regarding a method can also be contents of a product. Which embodiment is the best or not is different in accordance with objectives, required performance, and other factors.

Soft Magnetic Particles (Soft Magnetic Powder)

The soft magnetic particles according to the present invention comprise pure iron or an iron alloy. Pure iron powder is preferred because a high saturation magnetic flux density can be obtained and the magnetic properties of the dust core are improved. When a Si-containing iron alloy (Fe—Si alloy) powder, for example, is used as the iron alloy powder, its electrical resistivity is increased by Si, so that the specific resistance of the dust core can be improved and the eddy-current loss can be reduced accordingly.

In an alternative embodiment, the soft magnetic powder may be Fe-49Co-2V (permendur) powder, sendust (Fe-9Si-6Al) powder, or the like. The soft magnetic powder may also be a mixture of two or more types of powders. For example, a mixed powder of pure iron powder and Fe—Si alloy powder, or the like may be used.

The particle size of the soft magnetic particles can be adjusted in accordance with the spec of the dust core. The particle size of the soft magnetic powder is preferably 50 to 250 μm in an embodiment and 106 to 212 μm in another embodiment. An unduly large particle size may readily lead to a low-density dust core and/or an increased eddy-current loss, while an unduly small particle size may readily reduce the magnetic flux density of the dust core and/or increase the hysteresis loss.

As referred to in the present description, the "particle size" is indicative of the size of the soft magnetic particles and specified by sieving. Specifically, the median value [(d1+d2)/2] of the upper limit (d1) and the lower limit (d2) of the mesh size used for the sieving is employed as the particle size (D). The calculated value is rounded up or down to the nearest whole number and indicated in μm units.

Methods of manufacturing the soft magnetic powder are not limited. For example, an atomization method, a mechanical milling method, a reduction method, or the like may be employed. The atomized powder may be any of a water-atomized powder, a gas-atomized powder, and a gas-water-atomized powder. Atomized powders of which the particles are approximately spherical contribute to a high specific resistance of the dust core because breakage of the film and other troubles are less likely to occur when forming or molding the dust core.

Spinel-Type Ferrite (1) The ferrite according to the present invention is a type of iron oxide (ceramics), i.e., a magnetic material having a high insulating property, represented by $M_xFe_{3-x}O_4$ ($0<x\leq1$, preferably x=1) with a metal element (M), Fe, and O, where the metal element (M) serves as a divalent cation.

Provided that a spinel-type ferrite is formed, the type and number of metal elements contained in M are not limited. For example, M is Mn, Zn, Mg, Fe, Ni, Co, Cu, Sn, or Sr. The first metal element (M1) and the second metal element (M2) are included in M and are part of M.

Not only the barrier phase or the first ferrite as the precursor of the barrier phase, but also the main phase may contain M1 (M1: one or more of Cu, Sn, or Co). As previously described, however, M1 in $M1Fe_2O_4$ is reduced by Fe diffusing from the underlying soft magnetic particles and readily precipitates as M1 (metal). In this regard, the ferrite to be the main phase is preferably a second ferrite ($M2_zFe_{3-z}O_4$, $0<z\leq1$, preferably z=1) comprising one or more second metal elements (M2), Fe, and O, where the one or more second metal elements (M2) are different from M1 and serve as divalent cations.

M2 is preferably one or more of Mn, Zn, Mg, or Ni in an embodiment, one or more of Mn, Zn, or Mg in another embodiment, or one or more of Mn or Zn in still another embodiment. Ferrite containing such metal elements (in particular, Mn) tends to have a higher specific resistance and/or a higher magnetic moment (saturation magnetization) than those of ferrite containing other M, and both the electric properties (such as specific resistance) and the magnetic properties (such as magnetic flux density) of the dust core can be achieved at high levels.

The ferrite which constitutes the main phase is not limited to comprising a single composition and may also be composed of superimposed or mixed ferrites of plural compositions. For example, the main phase may be composed of a first ferrite including a barrier phase on the outermost surface side of the soft magnetic particles and a second ferrite present on the first ferrite and having a different composition from that of the first ferrite. In an alternative embodiment, the main phase may be composed of three or more types of ferrites having different component compositions. In an embodiment, the main phase or the grain boundary layer may be a gradient phase (gradient layer) in which the component composition varies from the outermost surface of the soft magnetic particles to the outermost surface of the film. As will be understood, in addition to M, Fe, and O, modifying elements and/or incidental impurities may be contained in each ferrite.

(2) Preferably, the barrier phase is eccentrically located near the soft magnetic particles with respect to the middle of the grain boundary layer. As the barrier phase is located nearer to the outermost surface of the soft magnetic particles, the main phase responsible for the insulating property of the grain boundary layer is more liable to be protected against the diffusing Fe from the soft magnetic particles.

From the same point of view, when using the particles for magnetic cores having the first ferrite and the second ferrite on the surface of the soft magnetic particles, the first ferrite (layer) as the precursor of the barrier phase is preferably located nearer than the second ferrite (layer) to the surface of the soft magnetic particles.

Figure 3:
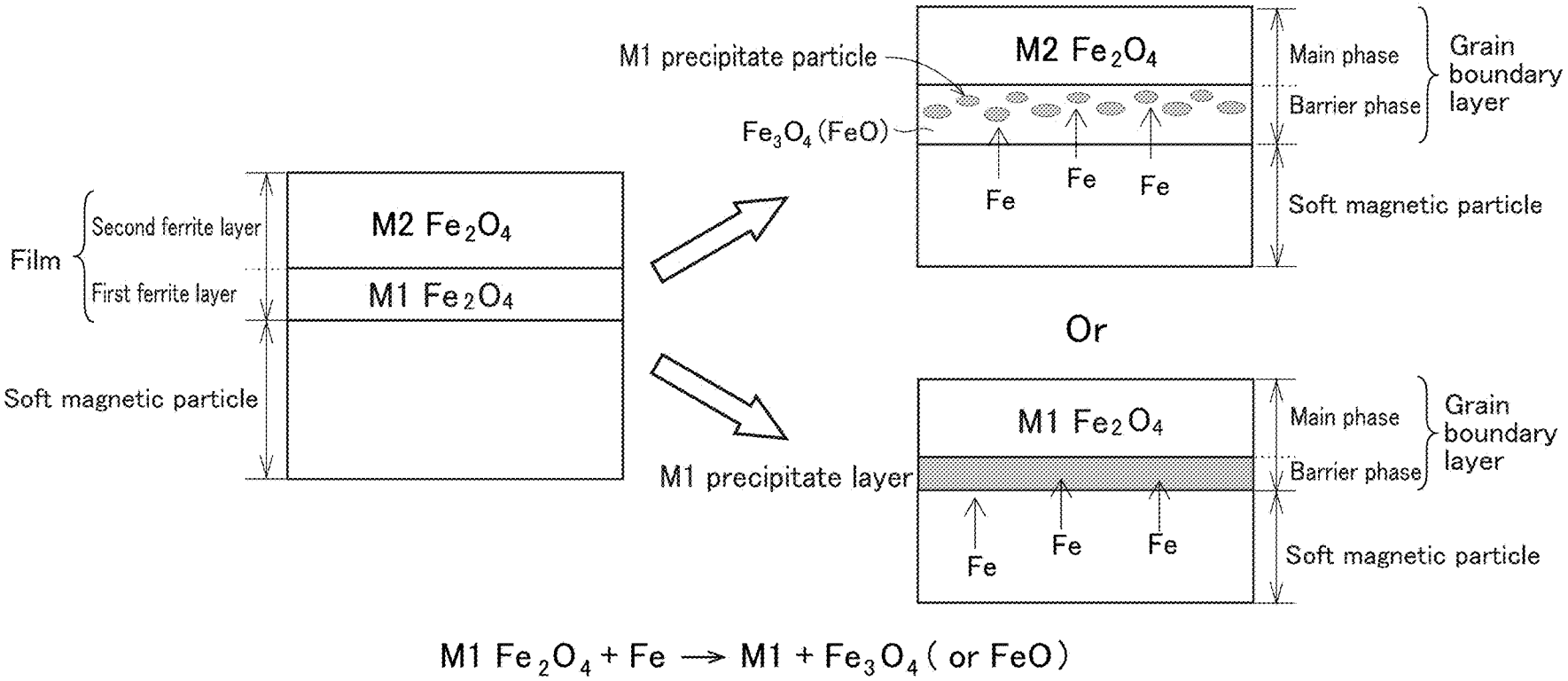
FIG. 3 is a schematic diagram demonstrating a process in which the film of particles for magnetic cores becomes a dust core's grain boundary layer including a barrier phase to block the Fe diffusion from soft magnetic particles to the main phase.

The barrier phase may cover the vicinity of the surface of the soft magnetic particles in a laminar form or may also be distributed in the vicinity of the surface of the soft magnetic particles in a granular form. For example, the barrier phase may be a granular metal (metal particles) of precipitated M1 or may also be a laminar metal (metal layer). Regardless of the form of the barrier phase, the barrier phase is present in the grain boundary layer thereby to block the diffusion of Fe to the main phase, and the high specific resistance of the dust core is stably maintained (see FIG. 3).

The barrier phase may be an M1 metal (simple substance) or may also be an alloy or a compound thereof. Such a barrier phase may usually be a nonmagnetic material or a low insulating material. Therefore, provided that the Fe diffusion to the main phase can be blocked, the amount of the barrier phase in the grain boundary layer or in the film is preferably small. For example, the thickness in which the barrier phase is distributed (the thickness in the normal direction of the soft magnetic particles) is preferably 5 to 300 nm in an embodiment and 50 to 150 nm in another embodiment. When the particle size of the soft magnetic particles is several tens to several hundreds of μm, the thickness of the grain boundary layer or the film is about 0.1 to 10 μm in an embodiment and about 1 to 5 μm in another embodiment. The thickness (film thickness, layer thickness) as referred to in the present description means the peak width (rise to fall) of the target element when measuring the distribution of elements existing in the grain boundary layer or the film.

Production Method (1) Ferrite Generation Step (Ferrite Plating Step)

There are various methods of generating ferrite on the surface of soft magnetic particles, including an aqueous solution method in which a powder to be treated (soft magnetic powder) is immersed in a reaction liquid (generation liquid) (reference: JP2013-191839A), a spray method in which a reaction liquid is sprayed on a powder to be treated (reference: JP2014-183199A), a one-liquid method using a reaction liquid that contains urea (reference: JP2016-127042A), etc. Any method can be employed to generate the ferrite according to the present invention.

The ferrite generation step may be repeated depending on the film thickness of the ferrite or the like. It is preferred to perform a washing step of removing unnecessary substances after the ferrite generation step. The washing step is carried out using an alkaline aqueous solution, water, ethanol, etc. Unnecessary substances to be washed are ferrite particles that did not contribute to the film formation, chlorine and sodium contained in the treatment liquid (reaction liquid, pH adjustment liquid), etc. It is preferred to dry the powder after the washing step. The drying step may include drying by heating rather than natural drying, thereby to efficiently manufacture the powder for magnetic cores.

The second generation step of generating the second ferrite serving as the main phase is preferably performed after the first generation step of generating the first ferrite as the precursor of the barrier phase. This allows the barrier phase to be formed on the outermost surface side of the soft magnetic particles, so that the deterioration of the main phase due to the diffusing Fe is readily suppressed.

(2) Powder Heating Step

It is preferred to perform, after the ferrite generation step, a powder heating step of heating the powder for magnetic cores at 100° C. to 700° C. in an embodiment and 150° C. to 650° C. in another embodiment in a non-oxidizing atmosphere. This can densify the film for the soft magnetic particles and/or promote the generation of the barrier phase in the film. In the dust core comprising the heat-treated powder for magnetic cores, the specific resistance change ratio with respect to the thermal hysteresis is small, and the high specific resistance tends to be stably maintained.

When densifying the film, the heating temperature is, for example, preferably 150° C. to 480° C. in an embodiment and 350° C. to 430° C. in another embodiment. When generating the barrier phase in the film, the heating temperature is, for example, preferably 520° C. to 700° C. in an embodiment and 570° C. to 650° C. in another embodiment.

(3) Annealing Step

The dust core is preferably subjected to an annealing step of heating a compact obtained in the molding step at 400° C. to 900° C. in an embodiment and at 500° C. to 700° C. in another embodiment in a non-oxidizing atmosphere. This can remove the strain introduced into the soft magnetic particles in the molding step, and the hysteresis loss due to the strain is reduced. The annealing step may be designed such that the barrier phase is generated from the film of the particles for magnetic cores. The non-oxidizing atmosphere as referred to in the present description is an inert gas atmosphere, a nitrogen gas atmosphere, a vacuum atmosphere, or the like.

Dust Corre

The specific resistance of the dust core is preferably 50μΩm or more in an embodiment, 100μΩm or more in another embodiment, and 200μΩm or more in still another embodiment. The coercivity of the dust core is preferably 200 A/m or less in an embodiment, 185 A/m or less in another embodiment, and 175 A/m or less in still another embodiment.

The dust core can be utilized, for example, in electromagnetic devices such as motors, actuators, transformers, inductive heaters (IH), speakers, and reactors. In particular, the dust core is preferably used as an iron core that constitutes an armature (rotor or stator) of an electric motor or a generator.

EXAMPLES

Two or more dust cores having different grain boundary layers were manufactured. Properties of each dust core were measured and the structures of the grain boundary layers were observed. The present invention will be described in more detail on the basis of such examples.

Production of Powder for Magnetic Cores (1) Soft Magnetic Powder (Raw Material Powder)

Gas-atomized powder comprising pure iron was used as the soft magnetic powder. The particle size was 212 to 106 μm→159 μm. How to specify the particle size is as previously described.

(2) Ferrite Generation Step

While stirring the soft magnetic powder heated to 130° C. in the air with a mantle heater, a first generation liquid (reaction liquid) was sprayed to the soft magnetic powder (first generation step). The first generation liquid was prepared by dissolving copper chloride ($CuCl_2$) and iron chloride ($FeCl_2$) weighed at a molar ratio of 1:2 in ion-exchange water. The soft magnetic powder after the spray treatment was washed with pure water (washing step) and dried by heating to 100° C. (drying step). Thus, a first treated powder comprising soft magnetic particles having surfaces coated with $CuFe_2O_4$ (first ferrite) was obtained.

The first treated powder was heated again to 130° C. in the air and a second ferrite generation liquid (reaction liquid) was sprayed to the first treated powder while stirring (second generation step). The second generation liquid was prepared by dissolving manganese chloride ($MnCl_2$), zinc chloride ($ZnCl_2$), and iron chloride ($FeCl_2$) weighed at a molar ratio of 0.5:0.5:2 in ion-exchange water. This second generation liquid was adjusted to pH 8. The first treated powder after the spray treatment was also washed with pure water (washing step) and dried by heating to 100° C. (drying step). Thus, a second treated powder (powder for magnetic cores) comprising soft magnetic particles having surfaces coated with $Mn_{0.5}Zn_{0.5}Fe_2O_4$ (second ferrite) was obtained (Sample 1). The ferrite generation step was conducted also with reference to the description of JP2014-183199A.

(3) Powder Heating Step

The second treated powder was placed in a heating furnace, and a powder for magnetic cores heated at 400° C. for 1 hour in a nitrogen atmosphere (non-oxidizing atmosphere) was also manufactured (Sample 2).

(4) Comparative Sample

A comparative sample was also manufactured as a powder for magnetic cores for which only the second generation step was carried out without performing the above-described first generation step (Sample C1).

Production of Dust Core (1) Molding Step

The powder for magnetic cores according to each sample was molded at 1200 MPa by a mold lubrication warm high-pressure molding method (references: JP3309970B and JP4024705B). Thus, a compact having a ring shape (40×30×4 mm) was obtained.

(2) Annealing Step

The compact according to each sample was placed in a heating furnace and heated at 600° C. for 1 hour in a nitrogen atmosphere (non-oxidizing atmosphere). Thus, a dust core according to each sample was obtained.

Measurement (1) Specific Resistance

The specific resistance of each dust core was measured by a four-terminal method (JIS K7194) using a digital multimeter (R6581 available from ADC Corporation). The measurement results are illustrated in FIG. 1.

(2) Coercivity

The coercivity of each dust core was measured using a DC recording fluxmeter (TRF-5A available from Toei Industry Co., Ltd). The measurement results are also illustrated in FIG. 1.

Observations

Figure 2A:
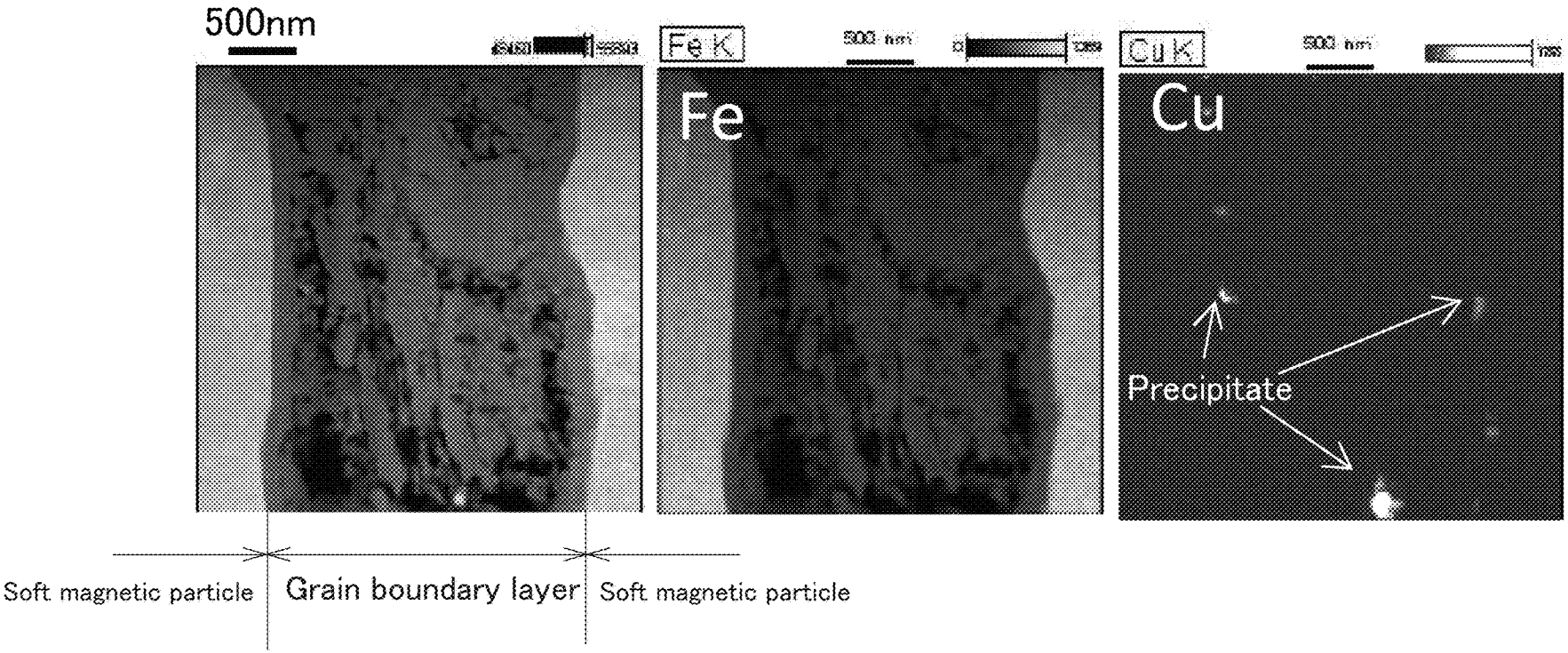
FIG. 2A is a set of element mapping images obtained by TEM observation of the grain boundary layer's cross section of a dust core according to Sample 2.
Figure 2B:
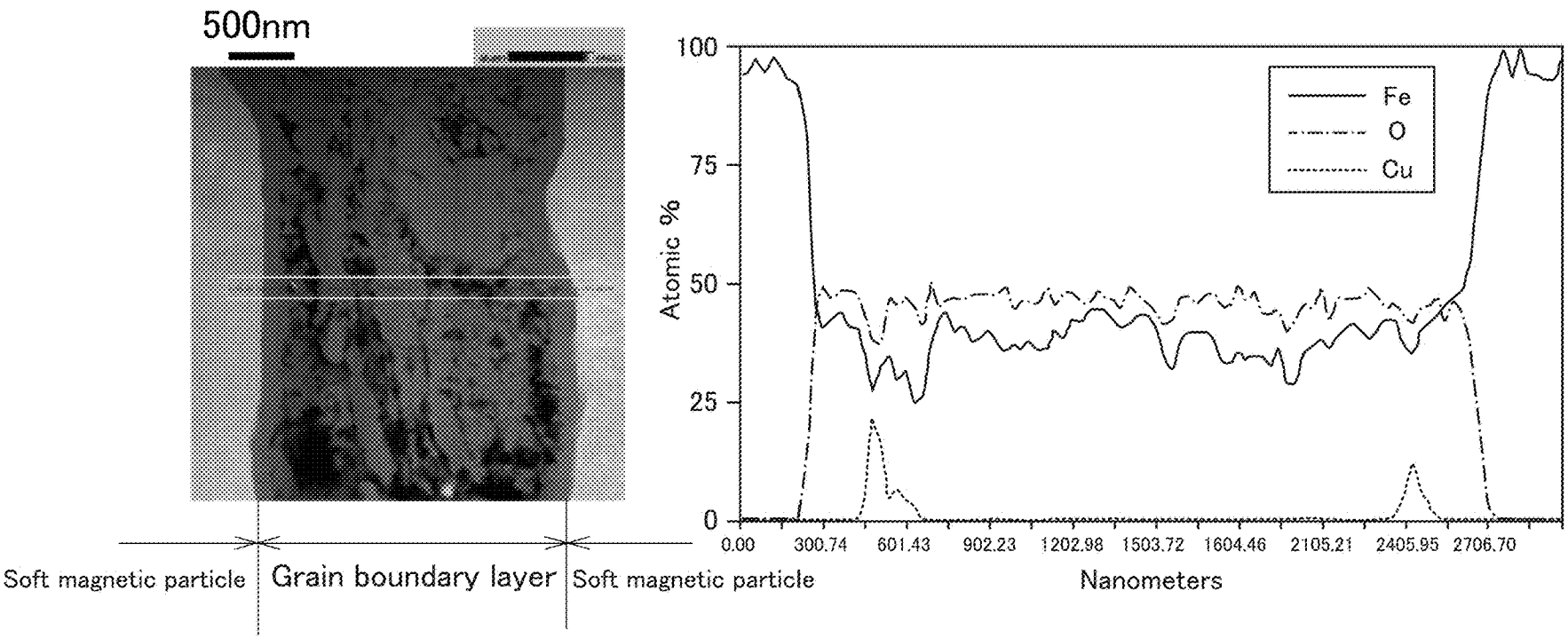
FIG. 2B is a graph illustrating the element distributions obtained by line analysis on the grain boundary layer.

The cross section of the dust core according to Sample 1 was observed using a transmission electron microscope (TEM) and energy-dispersive X-ray spectroscopy (EDX). The element mapping images and line analysis results thus obtained are illustrated in FIG. 2A and FIG. 2B (both of which are simply referred to as "FIG. 2"), respectively.

Evaluation (1) Specific Resistance and Coercivity

As is apparent from FIG. 1, it can be found that, unlike Sample C1, Samples 1 and 2 maintain sufficiently high specific resistance even after the annealing step. In particular, it has also been found that the specific resistance of Sample 2 is larger at different order of magnitude than that of Sample C1 as well as that of Sample 1. Moreover, Samples 1 and 2 exhibit smaller coercivity than that of Sample C1.

It has thus been found that, by using a powder for magnetic cores comprising soft magnetic particles having surfaces coated with the first ferrite ($CuFe_2O_4$) and/or by using a powder for magnetic cores obtained by preliminarily heat-treating the former powder for magnetic cores, dust cores are obtained with which both the eddy-current loss and the hysteresis loss can be reduced.

(2) Structure of Grain Boundary Layer

As is apparent from FIG. 2, it has been confirmed that the grain boundary layer of Sample 1 is a composite structure in which barrier phases comprising Cu precipitates are dispersed in the main phase comprising the spinel-type ferrite. It has also been found that the barrier phases are eccentrically located on the outermost surface side of the soft magnetic particles and their existence region is about 50 to 150 nm.

From the above, it has been revealed that the dust core obtained by molding and annealing the powder for magnetic cores comprising the soft magnetic particles coated with the first ferrite and the second ferrite has a grain boundary layer in which the main phase and the barrier phases coexist, and exhibits both the high specific resistance and the low coercivity at high levels.

The invention claimed is:

1. A dust core comprising: soft magnetic particles comprising pure iron or an iron alloy; and a grain boundary layer present between adjacent the soft magnetic particles, the grain boundary layer having a main phase and a barrier phase, the main phase comprising a spinel-type ferrite ($M_xFe_{3-x}O_4$, $0<x\leq1$) of a metal element (M), Fe, and O, the metal element (M) serving as a divalent cation, the barrier phase comprising one or more of Cu, Sn, or Co, wherein the main phase comprises plural types of spinel-type ferrites having different component compositions.

2. The dust core as recited in claim 1, wherein the barrier phase is eccentrically located near the soft magnetic particles with respect to a middle of the grain boundary layer.

3. The dust core as recited in claim 1, wherein the barrier phase is granular or laminar.

4. The dust core as recited in claim 1, wherein the metal element (M) includes Mn and/or Zn.

5. The dust core as recited in claim 1, wherein the dust core has a specific resistance of 50 μΩm or more and a coercivity of 200 A/m or less.

* * * * *